US006336230B1

(12) United States Patent
Lane

(10) Patent No.: US 6,336,230 B1
(45) Date of Patent: Jan. 8, 2002

(54) DEVICE FOR LIFTING PERSONS INTO AND OUT OF A BATHTUB

(76) Inventor: Sylvia M. Lane, P.O. Box 926, Bronx, NY (US) 10467

( * ) Notice: Subject to any disclaimer, the term of this patent is extended or adjusted under 35 U.S.C. 154(b) by 0 days.

(21) Appl. No.: 09/727,417

(22) Filed: Dec. 1, 2000

(51) Int. Cl.[7] ..... A47K 3/02
(52) U.S. Cl. ..... 4/566.1; 4/560.1; 4/565.1
(58) Field of Search ..... 4/560.1–566.1, 4/571.1, 578.1, 579, 604

(56) References Cited

U.S. PATENT DOCUMENTS

| | | | | |
|---|---|---|---|---|
| 3,106,723 A | | 10/1963 | Carpenter | |
| 3,581,316 A | * | 6/1971 | Petersen | 4/560.1 |
| 4,419,776 A | | 12/1983 | Schmidt | |
| 4,598,432 A | | 7/1986 | Pennington-Richards | |
| 4,726,081 A | | 2/1988 | Duffin et al. | |
| 4,768,239 A | | 9/1988 | Pauley | |
| 4,928,330 A | | 5/1990 | Moore | |
| 5,129,112 A | | 7/1992 | Schaffer | |
| 5,168,585 A | | 12/1992 | Cox | |
| 5,263,207 A | | 11/1993 | Gilbert | |
| 5,267,360 A | * | 12/1993 | Bassil et al. | 4/560.1 |
| 5,392,474 A | | 2/1995 | Schmidt | |
| D360,024 S | | 7/1995 | Smith | |
| 5,715,545 A | | 2/1998 | Forwick | |
| 5,839,131 A | | 11/1998 | Schaffer | |
| 6,003,168 A | | 12/1999 | Steadman | |
| 6,199,226 B1 | * | 3/2001 | Steadman | 4/565.1 |

* cited by examiner

*Primary Examiner*—Gregory L. Huson
*Assistant Examiner*—Tuan Nguyen

(57) ABSTRACT

The device for lifting persons into and out of a bathtub includes a housing having a U-shape with a first portion, a middle portion, and a second portion. A first tubular member is rotatably mounted in the first portion of the housing. A second tubular member is rotatably mounted in the second portion of the housing. The first and second tubular each have an axis of rotation orientated generally parallel to a longitudinal axis of the respective housing portion. A panel extends between the first and second tubular members. At least one motor is operatively coupled to the tubular members for rotating the tubular members. Control circuitry operationally coupled to the motor controls the motor.

7 Claims, 5 Drawing Sheets

DEVICE FOR LIFTING PERSONS INTO AND OUT OF A BATHTUB

BACKGROUND OF THE INVENTION

1. Field of the Invention

The present invention relates to lift devices for bathtubs and more particularly pertains to a new device for lifting persons into and out of a bathtub for assisting elderly and handicapped persons when entering and leaving a bathtub.

2. Description of the Prior Art

The use of lift devices for bathtubs is known in the prior art. More specifically, lift devices for bathtubs heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,392,474; 5,129,112; 4,598,432; 4,928,330; 5,263,207; 5,168,585; 3,106,723; 4,726,081; 4,419,776; 4,768,239; and U.S. Des. Pat. No. 360,024.

While these devices fulfill their respective, particular objectives and requirements, the aforementioned patents do not disclose a new device for lifting persons into and out of a bathtub. The inventive device includes a housing, the housing is elongate and has a pair of end walls. A peripheral wall extends between and is integrally coupled to the ends walls. The peripheral wall of the housing has a pair of bends therein. The housing generally has a U-shape taken from a plan view such that a first portion, a middle portion, and a second portion are defined. A bottom wall of the first and second portions has an elongate slit therein. A first tubular member is rotatably mounted in the first portion of the housing. The first tubular member has an axis of rotation orientated generally parallel to a longitudinal axis of the first portion. A second tubular member is rotatably mounted in the second portion of the housing. The second tubular member has an axis of rotation orientated generally parallel to a longitudinal axis of the second portion. A panel has a first edge positioned opposite of a second edge. The first edge is securely coupled to the first tubular member, and the second edge is securely coupled to the second tubular member. Each of a pair of motors is coupled to one of the tubular members. The motors are adapted to rotate the tubular members. Control circuitry operationally coupled to the motors controls the motors.

In these respects, the device for lifting persons into and out of a bathtub according to the present invention substantially departs from the conventional concepts and designs of the prior art, and in so doing provides an apparatus primarily developed for the purpose of assisting elderly and handicapped persons when entering and leaving a bathtub.

SUMMARY OF THE INVENTION

In view of the foregoing disadvantages inherent in the known types of lift devices for bathtubs now present in the prior art, the present invention provides a new device for lifting persons into and out of a bathtub construction wherein the same can be utilized for assisting elderly and handicapped persons when entering and leaving a bathtub.

The general purpose of the present invention, which will be described subsequently in greater detail, is to provide a new device for lifting persons into and out of a bathtub apparatus and method which has many of the advantages of the lift devices for bathtubs mentioned heretofore and many novel features that result in a new device for lifting persons into and out of a bathtub which is not anticipated, rendered obvious, suggested, or even implied by any of the prior art lift devices for bathtubs, either alone or in any combination thereof.

To attain this, the present invention generally comprises a housing, the housing is elongate and has a pair of end walls. A peripheral wall extends between and is integrally coupled to the ends walls. The peripheral wall of the housing has a pair of bends therein. The housing generally has a U-shape taken from a plan view such that a first portion, a middle portion, and a second portion are defined. A bottom wall of the first and second portions has an elongate slit therein. A first tubular member is rotatably mounted in the first portion of the housing. The first tubular member has an axis of rotation orientated generally parallel to a longitudinal axis of the first portion. A second tubular member is rotatably mounted in the second portion of the housing. The second tubular member has an axis of rotation orientated generally parallel to a longitudinal axis of the second portion. A panel has a first edge positioned opposite of a second edge. The first edge is securely coupled to the first tubular member, and the second edge is securely coupled to the second tubular member. Each of a pair of motors is coupled to one of the tubular members. The motors are adapted to rotate the tubular members. Control circuitry operationally coupled to the motors controls the motors.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new device for lifting persons into and out of a bathtub apparatus and method which has many of the advantages of the lift devices for bathtubs mentioned heretofore and many novel features that result in a new device for lifting persons into and out of a bathtub which is not anticipated, rendered obvious, suggested, or even implied by any of the prior art lift devices for bathtubs, either alone or in any combination thereof.

It is another object of the present invention to provide a new device for lifting persons into and out of a bathtub which may be easily and efficiently manufactured and marketed.

It is a further object of the present invention to provide a new device for lifting persons into and out of a bathtub which is of a durable and reliable construction.

An even further object of the present invention is to provide a new device for lifting persons into and out of a bathtub which is susceptible of a low cost of manufacture with regard to both materials and labor, and which accordingly is then susceptible of low prices of sale to the consuming public, thereby making such device for lifting persons into and out of a bathtub economically available to the buying public.

Still yet another object of the present invention is to provide a new device for lifting persons into and out of a bathtub which provides in the apparatuses and methods of the prior art some of the advantages thereof, while simultaneously overcoming some of the disadvantages normally associated therewith.

Still another object of the present invention is to provide a new device for lifting persons into and out of a bathtub for assisting elderly and handicapped persons when entering and leaving a bathtub.

Yet another object of the present invention is to provide a new device for lifting persons into and out of a bathtub which includes a housing, the housing is elongate and has a pair of end walls. A peripheral wall extends between and is integrally coupled to the ends walls. The peripheral wall of the housing has a pair of bends therein. The housing generally has a U-shape taken from a plan view such that a first portion, a middle portion, and a second portion are defined. A bottom wall of the first and second portions has an elongate slit therein. A first tubular member is rotatably mounted in the first portion of the housing. The first tubular member has an axis of rotation orientated generally parallel to a longitudinal axis of the first portion. A second tubular member is rotatably mounted in the second portion of the housing. The second tubular member has an axis of rotation orientated generally parallel to a longitudinal axis of the second portion. A panel has a first edge positioned opposite of a second edge. The first edge is securely coupled to the first tubular member, and the second edge is securely coupled to the second tubular member. Each of a pair of motors is coupled to one of the tubular members. The motors are adapted to rotate the tubular members. Control circuitry operationally coupled to the motors controls the motors.

Still yet another object of the present invention is to provide a new device for lifting persons into and out of a bathtub that is retrofittable to existing bathtubs.

Even still another object of the present invention is to provide a new device for lifting persons into and out of a bathtub that has padded peripheral walls to protect the user therefrom.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
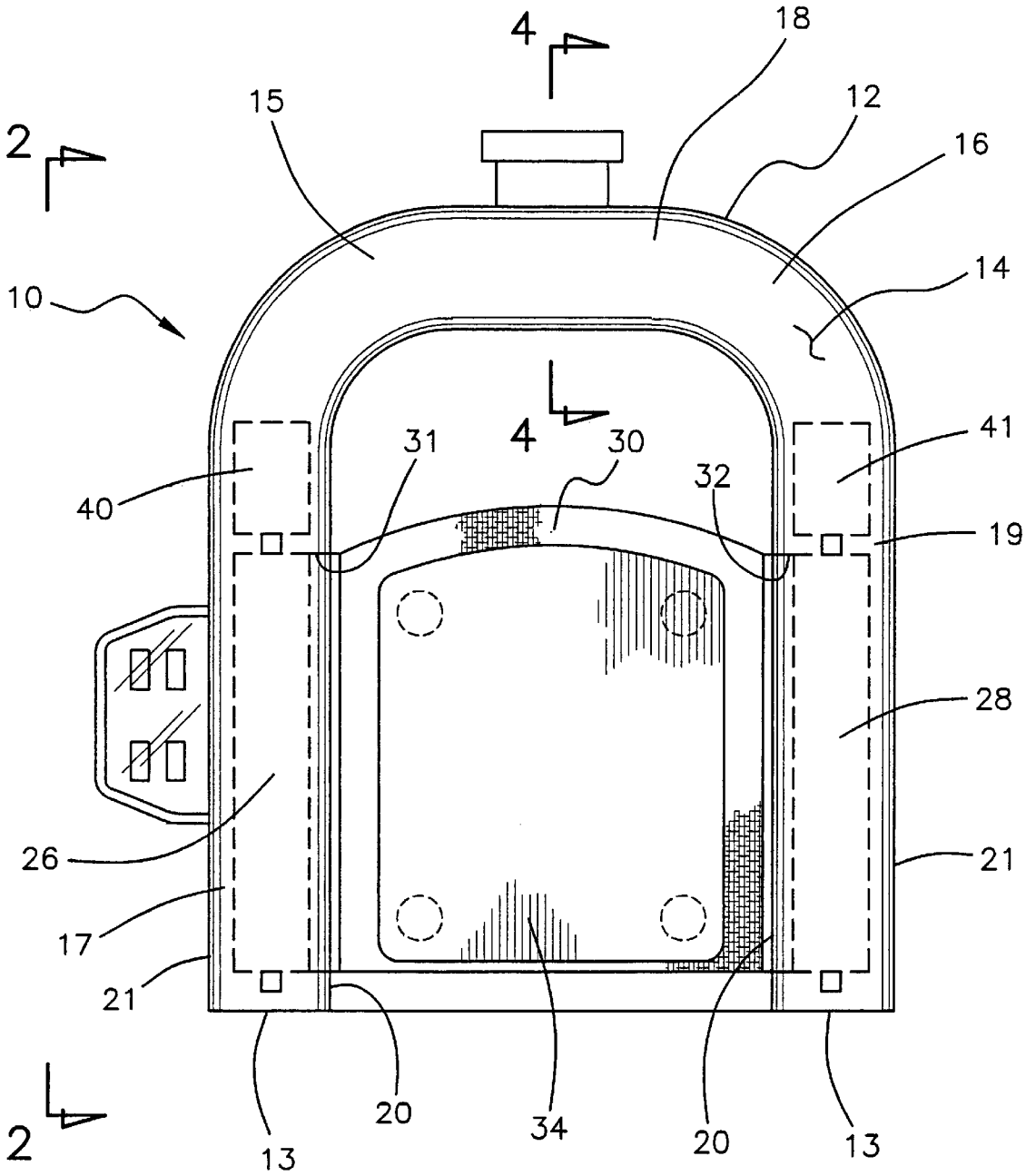
FIG. 1 is a schematic plan view of a new device for lifting persons into and out of a bathtub according to the present invention.
Figure 2:
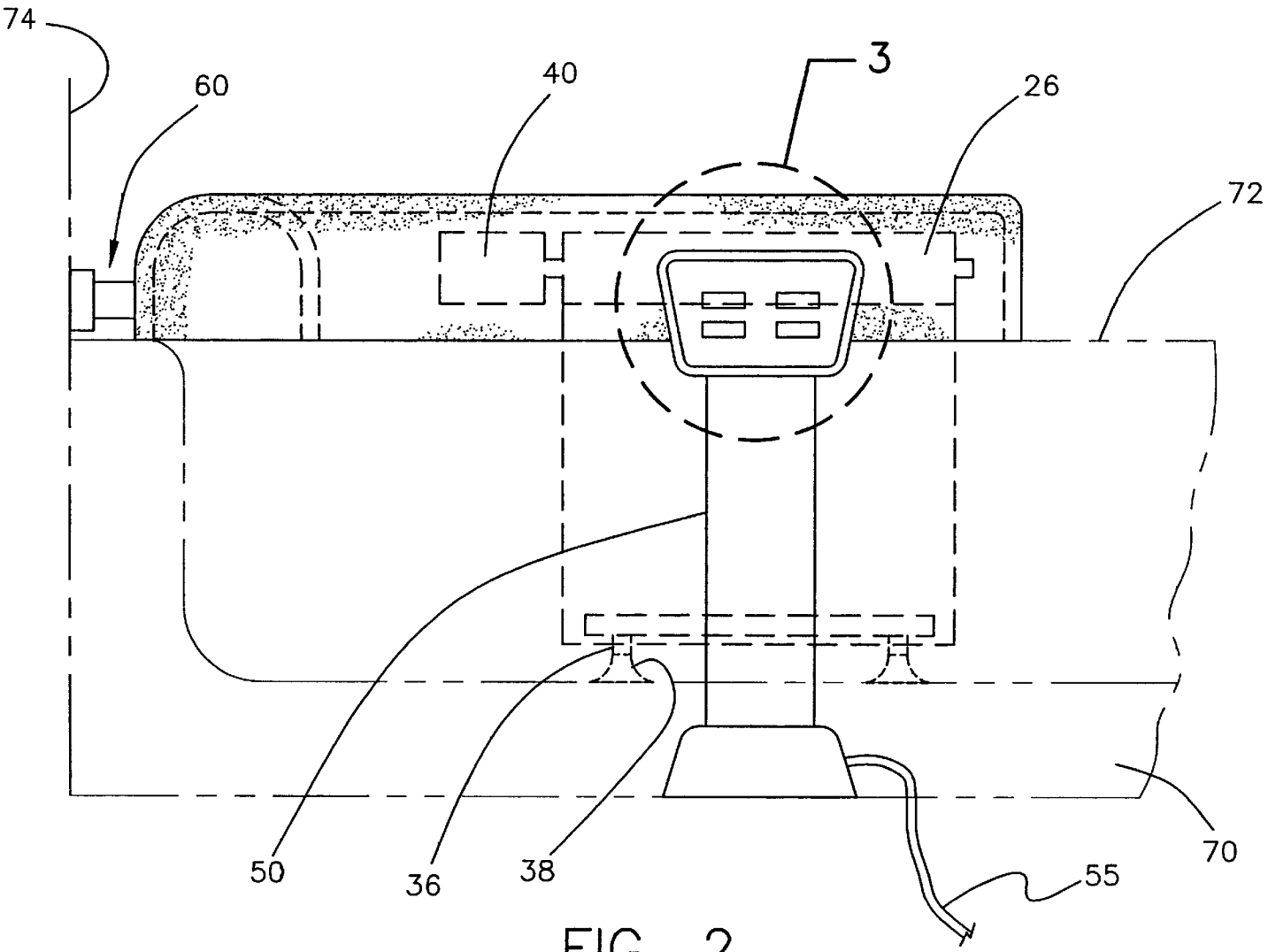
FIG. 2 is a schematic side view of the present invention.
Figure 3:
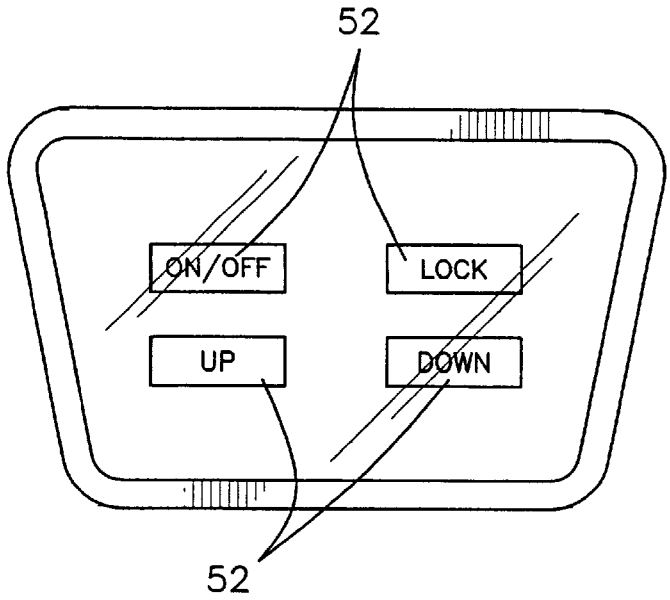
FIG. 3 is a schematic plan view of the actuators of the present invention.
Figure 4:
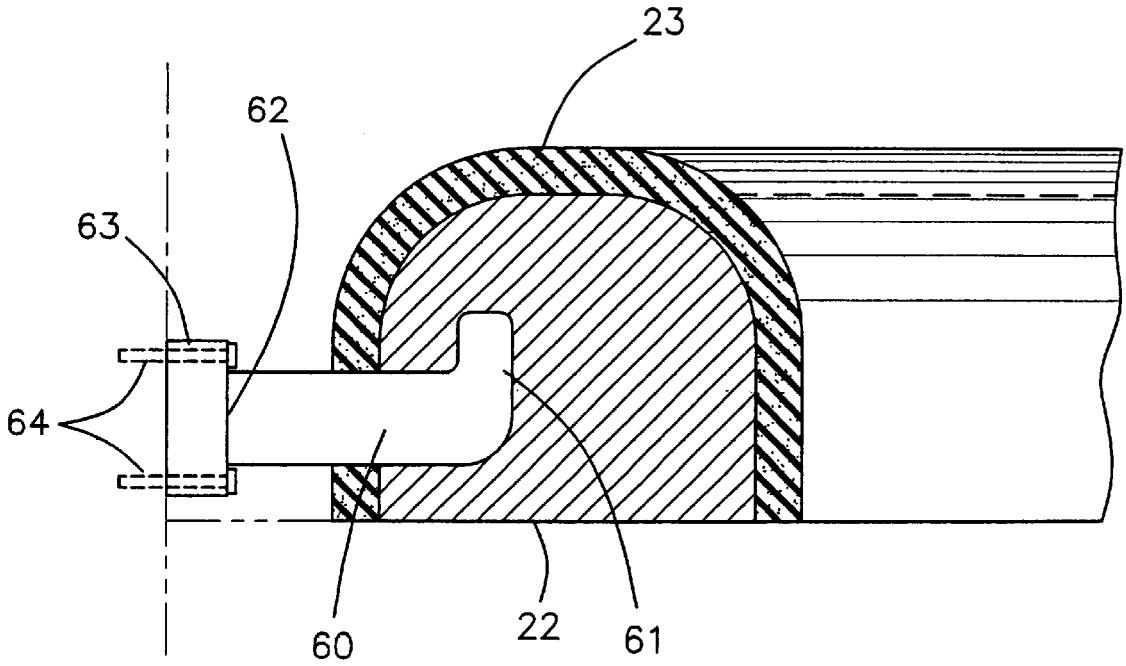
FIG. 4 is a schematic cross-sectional view taken along line 4—4 of the present invention.
Figure 5:
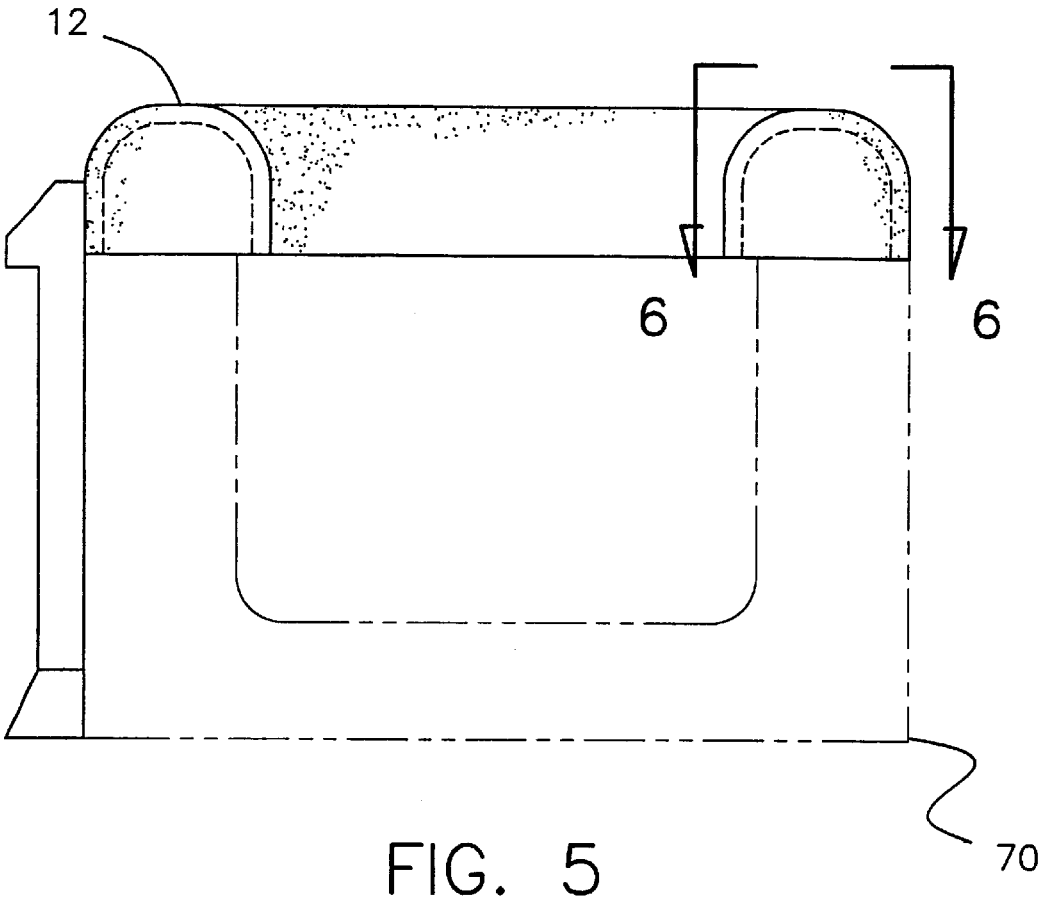
FIG. 5 is a schematic end view of the present invention.
Figure 6:
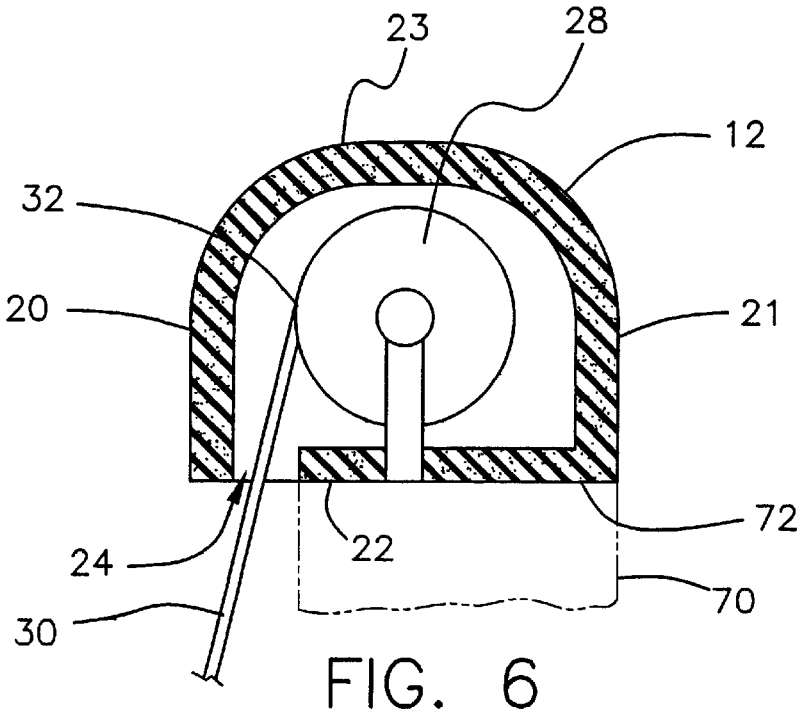
FIG. 6 is a schematic cross-sectional view taken along line 6—6 of the present invention.
Figure 7:
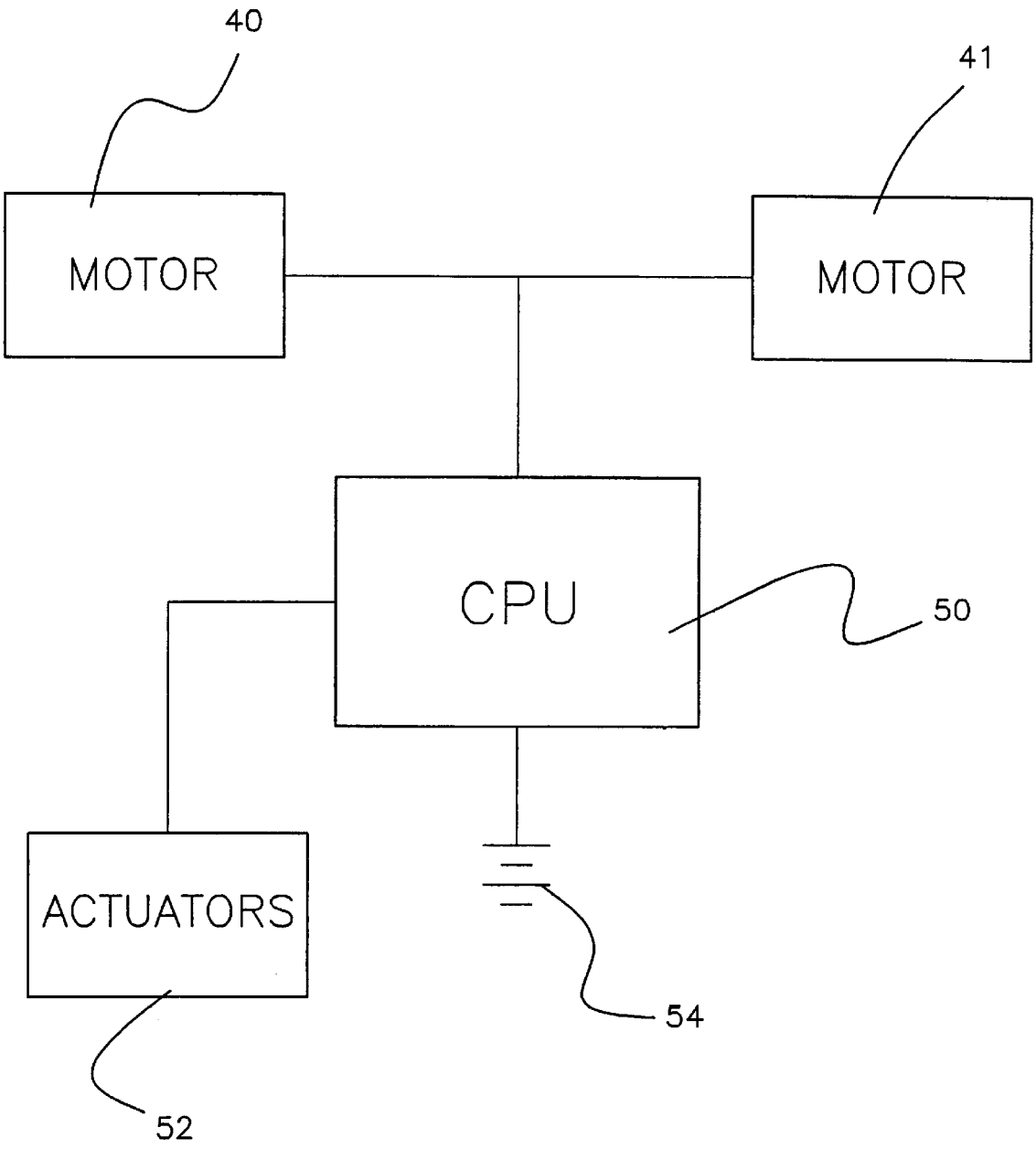
FIG. 7 is an electronic schematic view of the present invention.

With reference now to the drawings, and in particular to FIGS. 1 through 7 thereof, a new device for lifting persons into and out of a bathtub embodying the principles and concepts of the present invention and generally designated by the reference numeral 10 will be described.

As best illustrated in FIGS. 1 through 7, the device for lifting persons into and out of a bathtub 10 generally comprises a housing 12. The housing 12 is elongate and has a pair of end walls 13. A peripheral wall 14 extends between and is integrally coupled to the ends walls 13. The peripheral wall 14 of the housing 12 has a pair of bends 15, 16 therein. The housing 12 generally has a U-shape taken from a plan view such that a first portion 17, a middle portion 18, and a second portion 19 are defined. The peripheral wall 14 comprises an inner side wall 20, an outer side wall 21, a bottom wall 22 and a top wall 23. The bottom wall 22 of the first 17 and second 19 portions has an elongate slit 24 therein. The slits 24 are orientated generally parallel to and positioned generally adjacent to the inner side wall 20. The peripheral wall 14 comprises a padded material which is preferably a foamed elastomeric material. The housing 12 is positioned on the top edge 72 of a bathtub 70.

A first tubular member 26 is elongate and is rotatably mounted in the first portion 17 of the housing 12. The first tubular member 26 has an axis of rotation orientated generally parallel to a longitudinal axis of the first portion 17.

A second tubular member 28 is elongate and is rotatably mounted in the second portion 19 of the housing 12. The second tubular member 28 has an axis of rotation orientated generally parallel to a longitudinal axis of the second portion 19.

A panel 30 has a first edge 31 positioned opposite of a second edge 32. The first edge 31 is securely coupled to the first tubular member 26. The second edge 32 is securely coupled to the second tubular member 28. The panel 30 extends into the first 17 and second 19 portions through the slits 24.

A seat portion 34 comprises a plate securely attached to top surface of the panel 30 and generally positioned in middle portion of the panel 30. A plurality of legs 36 is each securely attached to and extends away from a bottom side of the plate. Each of the legs 36 extends through the panel 30. Each of legs 36 has a free end having a suction cup 38 integrally coupled thereto for releasably securing to the tub 70.

Each of a pair of motors 40, 41 is securely mounted in one of the first 17 and second 19 portions, respectively. Each of the motors 40, 41 is coupled to one of the tubular members 26, 28. The motors 40, 41 are adapted to rotate the tubular members. Each of the motors preferably comprises an electric motor.

Control circuitry 50 controls the motors 40, 41. The control circuitry 50 is securely mounted to the outer side wall 21. The control circuitry 50 is adapted to rotate the tubular members in tandem in a first direction and a second direction. The control circuitry 50 has actuators 52 operationally coupled thereto for actuating the motors 40, 41. The control circuitry 50 is operationally coupled to each of the motors 40, 41.

A power supply 54 powers the motors. The power supply is operationally coupled to the control circuitry 50. The power supply comprises a cord 55.

A mounting 60 comprises an elongate member having a first end 61 and a second end 62. The first end 61 extends into and is securely coupled to the outer wall 21 of the middle portion 18. An annular flange 63 is integrally coupled to and extends away from the second end 62 of the elongate member.

Each of a plurality of fastening means 64 extends through the flange 63 and into an adjacent wall 74. Each of the fastening means 64 preferably comprises a bolt.

In use, the housing 12 is placed on the top edge 72 of a bathtub 70. The user gets in the bathtub and sits on the seat portion 34. The control circuitry 50 is used to turn the motors on in a first direction to lower the user into the bathtub. When finished, the user uses the control circuitry to turn the motors in a second direction to lift the user out of the bathtub. The control circuitry is preferably adapted to having a lock actuator thereon for preventing unwanted rotation of the tubular members.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A lifting assembly for lifting a person in and out of a bathtub, said assembly being positionable on a top peripheral edge of a bathtub, said assembly being removably couplable to a wall, said assembly comprising:

a housing, said housing being elongate and having a pair of end walls, a peripheral wall extending between and being integrally coupled to said ends walls, said peripheral wall of said housing having a pair of bends therein, said housing generally having a U-shape taken from a plan view such that a first portion, a middle portion, and a second portion are defined, a bottom wall of said first and second portions having an elongate slit therein;

a first tubular member, said first tubular member rotatably mounted in said first portion of said housing, said first tubular member having an axis of rotation orientated generally parallel to a longitudinal axis of said first portion;

a second tubular member, said second tubular member being rotatably mounted in said second portion of said housing, said second tubular member having an axis of rotation orientated generally parallel to a longitudinal axis of said second portion;

a panel, said panel having a first edge positioned opposite of a second edge, said first edge being securely coupled to said first tubular member, said second edge being securely coupled to said second tubular member;

a pair of motors, each of said motors being coupled to one of said tubular members, said motors being adapted to rotate said tubular members; and control circuitry for controlling said motors, said control circuitry being operationally coupled to each of said motors;

a seat portion comprising a plate being securely attached to a top surface of said panel and generally positioned in said middle portion of said panel;

wherein said seat portion comprises a plurality of legs each being securely attached to and extending away from a bottom side of said plate, each of said legs extending through said panel;

wherein each of legs has a free end with a suction cup integrally coupled thereto for releasably securing to the bathtub.

2. The lifting assembly as in claim 1, wherein said control circuitry further comprises:

said control circuitry being securely mounted to an outer side wall portion of said peripheral wall, said control circuitry being adapted to rotate said tubular members in tandem in a first direction and a second direction, said control circuitry having actuators operationally coupled thereto for actuating said motors.

3. The lifting assembly as in claim 1, further comprising:

a mounting, said mounting comprising an elongate member having a first end and a second end, said first end extending into and being securely coupled to said outer wall of said middle portion, an annular flange being integrally coupled to and extending away from said second end of said elongate member; and at least one fastening means, said fastening means extending through said flange and into said wall.

4. A lifting assembly for lifting a person in and out of a bathtub, said assembly being positionable on a top peripheral edge of a bathtub, said assembly being removably couplable to a wall, said assembly comprising:

a housing, said housing being elongate and having a pair of end walls, a peripheral wall extending between and being integrally coupled to said ends walls, said peripheral wall of said housing having a pair of bends therein, said housing generally having a U-shape taken from a plan view such that a first portion, a middle portion, and a second portion are defined, said peripheral wall comprising an inner side wall, an outer side wall, a bottom wall and a top wall, said bottom wall of said first and second portions having an elongate slit therein, said slits being orientated generally parallel to and positioned generally adjacent to said inner side wall, said peripheral wall comprising a padded material, wherein said housing is positioned on the top edge of the bathtub;

a first tubular member, said first tubular member being elongate and being rotatably mounted in said first portion of said housing, said first tubular member having an axis of rotation orientated generally parallel to a longitudinal axis of said first portion;

a second tubular member, said second tubular member being elongate and being rotatably mounted in said second portion of said housing, said second tubular member having an axis of rotation orientated generally parallel to a longitudinal axis of said second portion;

a panel, said panel having a first edge positioned opposite of a second edge, said first edge being securely coupled to said first tubular member, said second edge being securely coupled to said second tubular member, said panel extending into said first and second portions through said slits;

a seat portion, said seat portion comprising a plate being securely attached to a top surface of said panel and generally positioned in middle portion of said panel, a plurality of legs being securely attached to and extending away from a bottom side of said plate, each of said legs extending through said panel, each of legs having a free end having a suction cup integrally coupled thereto for releasably securing to the tub;

a pair of motors, each of said motors being securely mounted in one of said first and second portions, each of said motors being coupled to one of said tubular members, said motors being adapted to rotate said tubular members, each of said motors comprising an electric motor;

control circuitry for controlling said motors, said control circuitry being securely mounted to said outer side wall, said control circuitry being adapted to rotate said tubular members in tandem in a first direction and a second direction, said control circuitry having actuators operationally coupled thereto for actuating said motors, said control circuitry being operationally coupled to each of said motors;

a power supply for powering said motors, said power supply being operationally coupled to said control circuitry, said power supply comprising a cord;

a mounting, said mounting comprising an elongate member having a first end and a second end, said first end extending into and being securely coupled to said outer wall of said middle portion, an annular flange being integrally coupled to and extending away from said second end of said elongate member; and a plurality of fastening means, each of said fastening means extending through said flange and into said wall, each of said fastening means comprising a bolt.

5. A lifting assembly for lifting a person in and out of a bathtub, said assembly comprising:

an elongate housing having a pair of end walls, a peripheral wall extending between and being coupled to said ends walls, said peripheral wall of said housing having a pair of bends therein, said housing generally having a U-shape comprising a first portion, a middle portion, and a second portion, a bottom wall of said first and second portions having an elongate slit therein;

a first tubular member rotatably mounted in said first portion of said housing, said first tubular member having an axis of rotation orientated generally parallel to a longitudinal axis of said first portion;

a second tubular member rotatably mounted in said second portion of said housing, said second tubular member having an axis of rotation orientated generally parallel to a longitudinal axis of said second portion;

a panel mounted on and extending between said first tubular member and said second tubular member;

at least one motor being operatively coupled to said tubular members in a manner permitting rotation of said tubular members by said at least one motor such that said at least one motor moves said panel between raised and lowered positions in the bathtub; and a seat mounted on a top surface of said panel, said seat having a plurality of legs mounted thereon and extending away from said seat, each of said legs extending through said panel and a bottom surface of said panel to abut against an interior surface of the bathtub when said panel is in a lowered position for supporting a user seated on said seat on the bathtub independent of said panel when said panel is in said lowered position, wherein each of said legs has a free end with a suction cup integrally coupled thereto for releasably securing to the bathtub.

6. The lifting assembly as in claim 5, additionally comprising control circuitry for controlling operation of said at least one motor, said control circuitry having actuators operationally coupled thereto for actuating said at least one motor.

7. The lifting assembly as in claim 5, further comprising a mounting comprising an elongate member having a first end and a second end, said first end extending into and being coupled to said outer wall of said middle portion, an annular flange being coupled to and extending away from said second end of said elongate member; and further comprising at least one fastening means extending through said flange and into said wall.

* * * * *